US006617780B2

(12) United States Patent
Cho et al.

(10) Patent No.: US 6,617,780 B2
(45) Date of Patent: Sep. 9, 2003

(54) DEFLECTION YOKE FOR BRAUN TUBE AND FABRICATION METHOD THEREOF

(75) Inventors: Sang Jun Cho, Taegu (KR); Seok Moon Lee, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/837,300

(22) Filed: Apr. 19, 2001

(65) Prior Publication Data

US 2003/0034725 A1 Feb. 20, 2003

(30) Foreign Application Priority Data

| | | |
|---|---|---|
| Apr. 19, 2000 | (KR) | 2000/20597 |
| Oct. 13, 2000 | (KR) | 2000/60281 |
| Nov. 7, 2000 | (KR) | 2000/65769 |

(51) Int. Cl.[7] ..... H01J 29/70; H01F 5/00

(52) U.S. Cl. ..... 313/440; 313/441; 335/213; 335/210; 335/299

(58) Field of Search ..... 313/440, 441, 313/428, 412; 335/213, 299, 210, 214, 212

(56) References Cited

U.S. PATENT DOCUMENTS

| | | | | |
|---|---|---|---|---|
| 4,396,897 A | * | 8/1983 | Sluijterman et al. | 335/212 |
| 4,405,910 A | * | 9/1983 | Ohtsu | 335/210 |
| 5,519,281 A | * | 5/1996 | Jamar | 313/440 |

* cited by examiner

*Primary Examiner*—Ashok Patel
*Assistant Examiner*—Sharlene Leurig
(74) *Attorney, Agent, or Firm*—Fleshner & Kim, LLP

(57) ABSTRACT

A deflection yoke for a Braun tube includes a primary 4-pole convergence yoke adapted to be positioned at a neck portion of a funnel of a Braun tube and a secondary 4-pole convergence yoke positioned in the vicinity of the funnel where horizontal and vertical deflection coils and a ferrite core are installed, for correcting a misconvergence generated due to the primary 4-pole convergence yoke, wherein at least one of the vertical and the horizontal deflection coils is wound at a first holder, and the secondary 4-pole convergence yoke is installed as an auxiliary coil wound on at least one side of the inner side or the outer side of the first holder. With this construction, occurrence of an inverse-magnetic field due to an induced magnetic field is prevented and thus a misconvergence can be easily corrected.

18 Claims, 16 Drawing Sheets

(a)

(b)

DEFLECTION YOKE FOR BRAUN TUBE AND FABRICATION METHOD THEREOF

BACKGROUND OF THE INVENTION

1. Field of the Invention

The present invention relates to a deflection yoke for a Braun tube, and more particularly, to an improved deflection yoke for a Braun tube having a secondary 4-pole convergence yoke for correcting a misconvergence caused by the primary 4-pole convergence yoke, and to a fabrication method thereof.

2. Description of the Background Art

FIG. 1 shows a partial sectional view of a general color Braun tube, which includes an electron gun 4 emitting three electron beams from the rear side of a funnel 3, a screen 1 on which the electron beams collide to produce light, a shadow mask 2 discriminating the three electron beams and a deflection yoke 30 deflecting the electron beams to determined points of the screen 1.

The Braun tube serves to receive an electric signal from an external source for an image, changes it to a light signal and displays it as an image having a spatial position on the screen 1 and a functional content (color, luminosity).

Accordingly, in the Braun tube, the content signal having information of the color of an image to be displayed on the screen 1 is applied to the electron gun 4 so that a desired color is shown on the screen 1 through the appropriate color combination of R, G and B electron beams and R, G and B phosphors on the screen, and the position signal of the image is applied to the deflection yoke 30 so that the position points of the screen 1 that the R, G and B electron beams emitted from the electron gun 4 reach are controlled to display a desired image.

The deflection yoke 30 includes a horizontal deflection coil 31 deflecting the electron beams emitted from the electron gun of the Braun tube in the horizontal direction, a vertical deflection coil 33 deflecting the electron beams in the vertical direction, a conical ferrite core 34 for reducing loss of a magnetic force generated from the horizontal and the vertical deflection coils 31 and 33 to heighten the magnetic efficiency, and a holder 32 fixing the horizontal and the vertical deflection coils 31 and 33 and the ferrite core 34 at pre-set positions with respect to the Braun tube.

A primary 4-pole convergence yoke 35 and a ring-shaped permanent magnet 36 are installed at a neck portion 31 of the funnel 31 to correct a misconvergence caused due to a fabrication error of the deflection yoke 30 and the Braun tube.

As for the Braun tube, by varying the distance between the R beam and the B beam emitted from the electron gun 4, the curvature of the shadow mask 2 can be considerably reduced more than the inner curvature of a panel forming the screen 1, and thus, the hawling and doming characteristics of the Braun tube can be improved.

As shown in FIG. 2A, the primary 4-pole convergence yoke 35 is constructed such that coils are wound in the 2 o'clock, 5 o'clock, 7 o'clock and 10 o'clock positions to form magnetic fields as shown in FIG. 2B.

As shown in FIG. 3, in order to correct a misconvergence of a screen varied due to the primary 4-pole convergence yoke 35, a secondary 4-pole convergence yoke 40, on which auxiliary coils 41 are wound in the 12 o'clock, 6 o'clock, 3 o'clock and 9 o'clock positions, is provided at the ferrite core 34.

As shown in FIG. 4, in the deflection yoke, in order to apply a driving current to the primary and the secondary 4-pole convergence yokes 35 and 40, an amplifying circuit is connected in parallel with the vertical deflection coil 33 and an integrating circuit is connected in series with the vertical deflection coil 33. And in order to prevent an induced current from being generated in the secondary 4-pole convergence yoke 40, an induced current preventing circuit is provided to synchronize the parallelly connected horizontal deflection coil 31 and the serially connected horizontal compensation coil 51 to a vertical compensation coil 53.

The vertical compensation coil 53 is connected in series with the amplifying circuit and the integrating circuit and also connected in series with the secondary 4-pole convergence yoke 40.

The deflection yoke 30 constructed as described above supplies current generally having a frequency of 15.75 kHz or more to the horizontal deflection coil 31 which generates a deflecting magnetic field that deflects the electron beam in the Braun tube in the horizontal direction.

The deflection yoke 30 is formed to have a self-convergence form which is capable of converging the electron beams on a screen by applying a non-uniform magnetic field by the horizontal and vertical deflection coils 31 and 33 even when the three electron beam guns do not use any supplemental circuit or device.

In other words, in the deflection yoke, the winding distributions of the horizontal deflection coil 31 and the vertical deflection coil 33 are adjusted to form a barrel type or a pin-cushion type magnetic field by regions (an opening portion, a middle portion and a neck portion). Then, each of the three electron beams has a different deflection force according to its position, and thus, the electron beams are converged to the same point on the screen even from different distances of each beam from a starting point to an arrival point.

In addition, in the case where a magnetic field is formed by applying a current to the horizontal and the vertical deflection coils 31 and 33, it is difficult to deflect the electron beams over the entire screen only with the magnetic field applied by the horizontal and the vertical deflection coils 31 and 33. Thus, the ferrite core 34 is used to minimize the loss in the return path of the magnetic field, thereby heightening the magnetic field and increasing the magnetic force.

In the Braun tube, the howling and the doming characteristics of the shadow mask 2 may be degraded due to the planarization of the screen 1. Thus, after the primary 4-pole convergence yoke 35 is installed at the neck portion 3*a* of the funnel 3 to be symmetrical horizontally and vertically as shown in FIGS. 1 and 2, when the vertical deflection current (the current indicated by a dotted line in FIG. 5) supplied by the circuit illustrated in FIG. 4 is applied thereto, the magnetic fields B1 and B2 shown in FIG. 2B are formed at the primary 4-pole convergence yoke 35, so that the R beam receives a force in the 3 o'clock direction at the point 'A' and the B beam receives a force in the 9 o'clock direction.

At this time, on the screen 1", the paths of the R beam and the B beam are not changed at the points 'B' and E', However, as shown in FIG. 5, at the points 'C' and 'F', the upper and lower end portions of the screen 1", since the current flows in the opposite direction, a magnetic field is formed in the opposite direction to that of the magnetic field as shown in FIG. 2B. Accordingly, the R beam receives a force in the 9 o'clock direction and the 'B' beam receives a force in the 3 o'clock direction, and thus, the positions of the R and the B beams are changed in the horizontal directions. As the beams trace other points of the screen 1", the applied magnetic field is changed in proportion to the change in the beam position at the A–F points.

When the primary 4-pole convergence yoke 35 is operated, the distance between the R beam and the B beam at the center of the deflection yoke 30 is the longest at the point 'A' and the shortest at the points 'C' and 'F'.

Meanwhile, the changes in the positions of the R beam and the B beam in the horizontal direction signify the change of the angle at which the R and the B beams are made incident on the shadow mask. In this respect, a small incident angle is called a grouping and a large incident angle is called a degrouping.

With reference to FIG. 7, the degree (G) of grouping is expressed by the following equation:

$$G=(3SQ/PhL) \quad (1)$$

wherein 'S' indicates a distance between the R and the B beams at the deflection center of the deflection yoke 30, 'Q' indicates a distance from the inner face of a panel 1' to the shadow mask 2, 'Ph, indicates a horizontal position on the shadow mask 2, and 'L' indicates a distance from the deflection center of the deflection yoke 30 to the inner face of the panel 1'.

As noted in the above equation, as shown in FIG. 7, as the distance difference (S) between the R and the B beams becomes great at the point 'A' of the screen 1" by operation of the primary 4-pole convergence yoke 35, the beam grouping degree is varied. A solution to this is to reduce the distance (Q) between the inner face of the panel 1' to the shadow mask 2. Then, the beam grouping degree is not varied.

Thus, it can be noted that due to the variation of the distance difference (S) between the R and the B beam at the deflection yoke 30 produced by the primary convergence yoke 35, the distance (Q) from the inner face of the panel 1' to the shadow mask 2 is shortest at the point 'A' of the screen 1" and longest at the points 'C' and 'F'.

That is, as the beam 'S' value is varied by the magnetic field produced by the primary 4-pole convergence yoke 35, the distance (Q) from the inner face of the panel to the shadow mask 2 can be varied. Thus, the panel 10 and the shadow mask 2 may have the same curvature as shown in FIG. 8A, or the shadow mask 2 may have a smaller curvature than the inner curvature of the panel 10' as shown in FIG. 8*b*, so that the hawling and doming phenomenon caused due to the planarized shadow mask 2 can be improved.

With reference to FIG. 7, 'a' indicates a state that the 'S' value is changed by the primary 4-pole convergence yoke 35, 'b' indicates a state that a convergence is compensated by the secondary 4-pole convergence yoke 40, and 'c' indicates a state that a static convergence is formed by the electron gun.

However, as for the Braun tube having the above-described deflection yoke, when the beam grouping degree is changed by the primary 4-pole convergence yoke 35, a misconvergence occurs on the screen.

In order to correct the misconvergence, the secondary 4-pole convergence yoke 40 having auxiliary coils 41 wound in the 12 o'clock, 6 o'clock, 3 o'clock and 9 o'clock directions of the ferrite core 34 is installed, to which a vertical deflection current indicated by the dotted line in FIG. 5 is applied. Then, as shown in FIG. 3B, magnetic fields (B3–B6) are formed in the opposite direction to the magnetic fields of the primary 4-pole convergence yoke 35 of FIG. 2B.

Accordingly, the R beam is deflected by the force (F4) of the magnetic field B5 at the point 'A' of the screen 1" and is moved in the direction of 9 o'clock, and the B beam is deflected by the force (F3) of the magnetic field (B3) and is moved in the direction of 3 o'clock.

The R and the B beams are not moved at the points B and E of the screen. And as shown in FIG. 5, since the current direction at the points 'C' and 'F' of the screen are opposite to the current direction at the point 'A' of the screen, so that the magnetic fields are formed in the directions as shown in FIG. 3B and the R and the B beams are moved in the opposite direction to the point 'A' of the screen.

This is the opposite direction to the R and the B beams which are deflected by the magnetic fields B1 and B2 generated by the primary 4-pole convergence yoke 35, so that the secondary 4-pole convergence yoke 40 can correct the misconvergence of the beams on the screen generated by the primary 4-pole convergence yoke 35.

However, since the Braun tube of the conventional art mounts the secondary 4-pole convergence yoke 40 at the ferrite core 34, an induced electromotive force is generated at the auxiliary coil 41 of the ferrite core 34 by the magnetic field of the horizontal deflection coil 31 as shown in FIG. 9, and the magnetic field is generated to the auxiliary coil 41 in the direction of interfering with the horizontal deflection magnetic field by the induced electromotive force, generating a misconvergence on the screen.

In order to prevent occurrence of the misconvergence, as shown in FIG. 4, a circuit for preventing an induced current needs to be installed at the secondary 4-pole convergence yoke 40 by synchronizing the horizontal compensation coil 51 and the vertical compensation coil 53, which results in that the fabrication cost of products employing such a Braun tube is increased.

In addition, in the conventional Braun tube, the auxiliary coil 41 is wound on the ferrite core 34 by using an additional winding machine to construct the secondary 4-pole convergence yoke 40, which causes a problem that much time is taken for winding the auxiliary coil 41.

Moreover, when the secondary 4-pole convergence yoke 40 is combined with the ferrite core 34, the misconvergence on the screen is varied due to the combination dispersion, resulting in that its productivity is degraded and production cost is increased.

SUMMARY OF THE INVENTION

Therefore, an object of the present invention is to provide a deflection yoke for a Braun tube which is capable of preventing occurrence of an inverse-magnetic field due to an induced magnetic field and thus easily correcting a misconvergence of a screen by having a construction wherein a secondary 4-pole convergence yoke is mounted on a holder on which a deflection coil is wound, rather than at a ferrite core, or on a separate holder, and its fabrication method.

Another object of the present invention is to provide a deflection yoke for a Braun tube which is capable of improving assembly and productivity of a secondary 4-pole convergence yoke by winding or mounting the secondary 4-pole convergence yoke on a holder, and its fabrication method.

To achieve these and other advantages and in accordance with the purpose of the present invention, as embodied and broadly described herein, there is provided a deflection yoke for a Braun tube including a primary 4-pole convergence yoke adapted to be positioned at a neck portion of a funnel of a Braun tube and a secondary 4-pole convergence yoke adapted to be positioned in the vicinity of the funnel where horizontal and vertical deflection coils and a ferrite core are installed, for correcting a misconvergence generated due to the primary 4-pole convergence yoke, wherein at least one of the vertical and the horizontal deflection coils is wound on a first holder, and the secondary 4-pole convergence yoke is installed in such a manner that an auxiliary coil thereof is wound on at least one side of the inner side or the outer side of the first holder.

To achieve the above objects, there is also provided a deflection yoke for a Braun tube including a primary 4-pole convergence yoke adapted to be positioned at a neck portion of a funnel and a secondary 4-pole convergence yoke positioned in the vicinity of the funnel of a Braun tube where horizontal and vertical deflection coils and a ferrite core are installed, for correcting a misconvergence generated due to the primary 4-pole convergence yoke, wherein at least one of the vertical and the horizontal deflection coils is wound on a first holder, and a secondary 4-pole convergence yoke is installed having an auxiliary coil on a second holder which may be inserted into an inner side or on an outer side of the first holder.

To achieve the above objects, there is also provided a deflection yoke for a Braun tube including a primary 4-pole convergence yoke adapted to be positioned at a neck portion of a funnel of a Braun tube and a secondary 4-pole convergence yoke adapted to be positioned in the vicinity of the funnel where horizontal and vertical deflection coils and a ferrite core are installed, for correcting a misconvergence generated due to the primary 4-pole convergence yoke, wherein the secondary 4-pole convergence yoke is mounted on an outer side of the funnel.

To achieve the above objects, there is also provided a method for fabricating a deflection yoke for a Braun tube including a primary 4-pole convergence yoke adapted to be positioned at a neck portion of a funnel of a Braun tube and a secondary 4-pole convergence yoke adapted to be positioned in the vicinity of the funnel where horizontal and vertical deflection coils and a ferrite core are installed, for correcting a misconvergence generated due to the primary 4-pole convergence yoke, wherein the secondary 4-pole convergence yoke is fabricated in two steps by successively winding a coil in a flat form and bending both sides of the coil in the same direction to thereby form an auxiliary coil, and then insertedly mounting the auxiliary coil onto the inner side or the outer side of a holder where the secondary 4-pole convergence yoke is to be installed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the detailed description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a deflection yoke for a Braun tube in accordance with the present invention, of which the most preferred embodiments will now be described.

Figure 10:
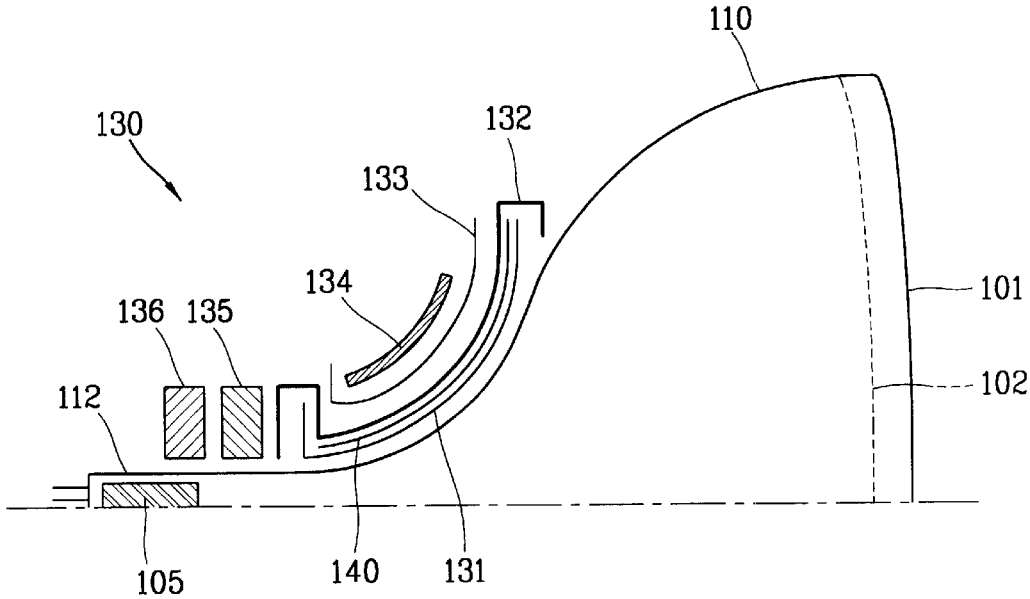
FIG. 10 is a schematic sectional view of a Braun tube having a deflection yoke in accordance with a first embodiment of the present invention.

FIG. 10 is a schematic sectional view of a Braun tube having a deflection yoke in accordance with a first embodiment of the present invention.

The Braun tube includes an electron gun 105 for emitting three electron beams from the rear side of a funnel 110, a phosphor screen 101 with which the electron beams collide to produce light, a shadow mask 102 discriminating the three electron beams and a deflection yoke 130 deflecting the electron beams to pre-determined points of the screen 101.

The deflection yoke 130 controls the position points at which the R, G and B electron beams emitted from the electron gun 105 impinge upon the screen 101 to display a desired image.

The deflection yoke 130 includes a horizontal deflection coil 131 horizontally deflecting the electron beams emitted from the electron gun 105 inside Braun tube, a vertical deflection coil 133 vertically deflecting the electron beams, a conical ferrite core 134 reducing the loss of magnetic force generated from the horizontal and vertical deflection coils 131 and 133 to thereby heighten their magnetic efficiency, and a slitted holder 132 fixing the horizontal and vertical deflection coils 131 and 133 and the ferrite core 134 at a predetermined position on the funnel 110 of the Braun tube.

The deflection yoke 130 also includes a primary 4-pole convergence yoke 135 and a ring-shaped permanent magnet 136 positioned at a neck portion 112 of the funnel 110 so as to correct a misconvergence caused due to a fabrication error of the deflection coils 131 and 133 and Braun tube.

Especially, the slitted holder 132 includes a secondary 4-pole convergence yoke 140 to correct a misconvergence generated by the primary 4-pole convergence yoke 135.

The secondary 4-pole covergence yoke 140 is installed having an auxiliary coil wound at the inner side of the slitted holder 132.

Figure 11:
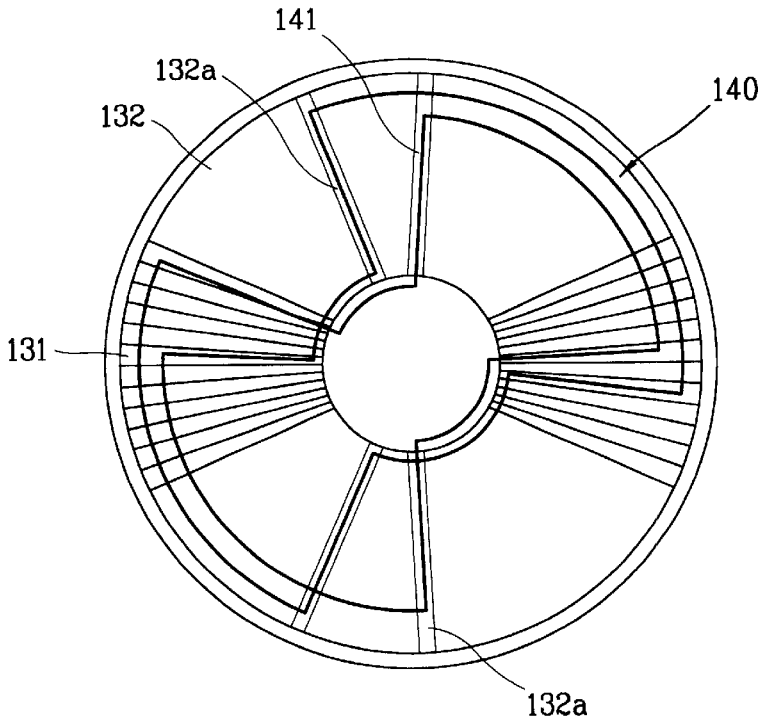
FIG. 11 is a plan view of a holder with a coil wound thereon in accordance with the first embodiment of the present invention.

FIG. 11 is a plan view of a holder with a coil wound in accordance with the first embodiment of the present invention.

With reference to FIG. 11, in the slitted holder 132, the horizontal deflection coil 131 is wound in the directions of 3 o'clock and 9 o'clock, and a plurality of winding type grooves 132*a* are formed in the holder 132 so that the auxiliary coil 141 forming the secondary 4-pole convergence yoke 140 can be positioned.

The winding grooves 132*a* are formed to extend in the longitudinal direction of the slitted holder 130 at 90° intervals in the positions of 12 o'clock, 3 o'clock, 6 o'clock and 9 o'clock.

The auxiliary coil 141 forming the secondary 4-pole convergence yoke 140 is wound to be installed in the winding grooves 132*a* of the slitted holder 132 in the directions of 0°, 90°, 180° and 270° centering around the horizontal axis of the Braun tube.

Figure 12:
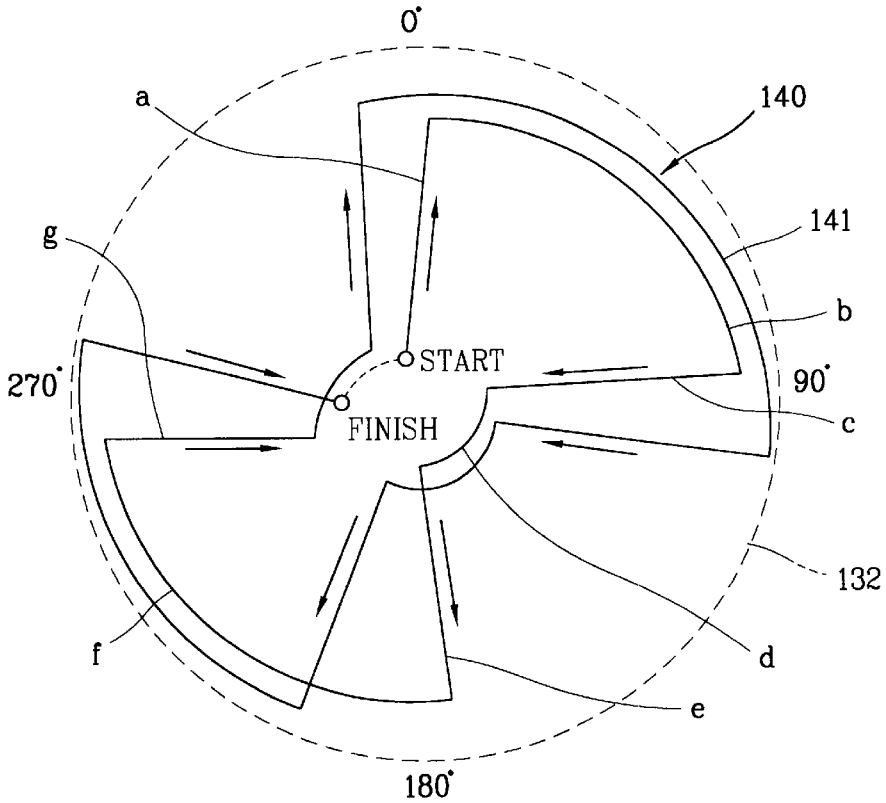
FIG. 12 is a diagram showing an auxiliary coil winding method of the secondary 4-pole convergence yoke in accordance with the first embodiment of the present invention.

FIG. 12 is a diagram showing an auxiliary coil winding method of the secondary 4-pole convergence yoke in accordance with the first embodiment of the present invention.

The secondary 4-pole convergence yoke 140 is constructed in a manner that the auxiliary coil 141 is successively wound starting from one end of the slitted holder 132, that is, at the neck portion of the funnel, and it extends to the other end, that is, the screen side, at the same angle running in a straight line (a), making a turn of about 90° to form a flange at the other end (b), then extending back again running in a straight line in the vicinity of 90° from the starting position (c), making a turn of about 90° to form a flange at the first end (d), then extending to the other end running in a straight line in the vicinity of 180° from the starting position (e), making a turn of about 90° at the other end (f) to form a flange, and then extending again to the first end running in a straight line in the vicinity of 270° from the starting position.

In this manner, the auxiliary coil 141 is repeatedly wound at the slitted holder 132 several times, completing the secondary 4-pole convergence yoke 140.

Figure 13:
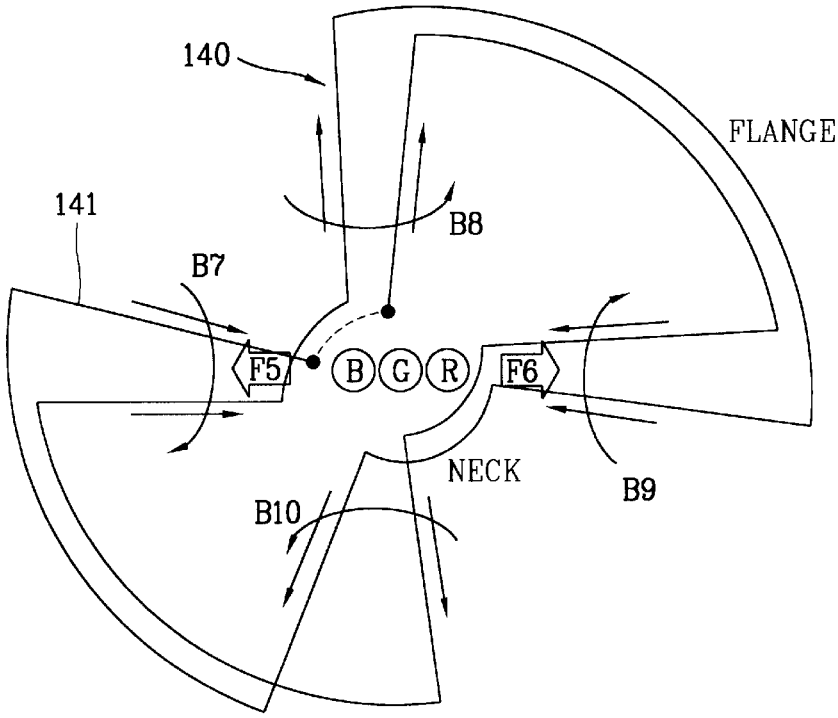
FIG. 13 is a diagram showing the formation of magnetic fields of the secondary 4-pole convergence yoke in accordance with the first embodiment of the present invention.

FIG. 13 is a diagram showing the formation of magnetic fields produced by the secondary 4-pole convergence yoke in accordance with the first embodiment of the present invention.

After the auxiliary coil 141 for the secondary 4-pole convergence yoke is wound at the slitted holder 132 where the horizontal deflection coil has been wound, when a vertical deflection current is applied to the auxiliary coil 141, magnetic fields (B7~B10) are generated, so that the R beam is deflected by the force (F6) and is moved in the direction of 3 o'clock and the B beam is deflected by the force F6 and is moved in the direction of 9 o'clock.

Accordingly, the secondary 4-pole convergence yoke 140 forms magnetic fields in the opposite direction to the magnetic fields generated by the primary 4-pole convergence yoke 135, so that the R beam is moved in the direction of 9 o'clock and the B beam is moved in the direction of 3 o'clock, to correct a misconvergence generated at the primary 4-pole convergence yoke 135.

Figure 14:
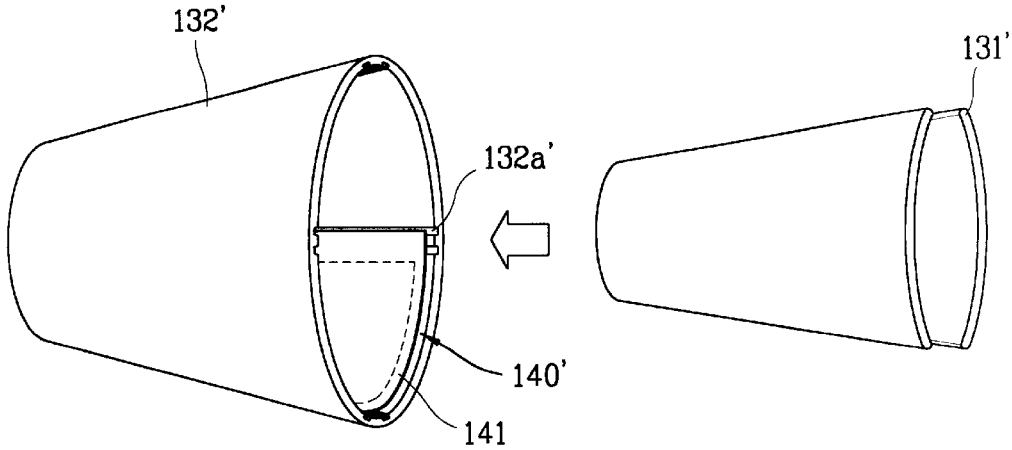
FIG. 14 is an exploded perspective view which illustrates a state of assembly of the secondary 4-pole convergence yoke and a horizontal deflection coil in accordance with the first embodiment of the present invention.

FIG. 14 illustrates a state of assembly of the secondary 4-pole convergence yoke and a horizontal deflection coil in accordance with the first embodiment of the present invention.

With reference to FIG. 14, a secondary 4-pole convergence yoke 140' may be constructed such that an auxiliary coil 141' is wound along the winding groove 132*a*' formed at the inner side of a muscle type holder 132' in the positions of 12 o'clock, 3 o'clock, 6 o'clock and 9 o'clock similarly to in FIG. 12 and a muscle type horizontal deflection coil 131' without a flange is assembled with the muscle type holder 132'.

As described above, in case of the deflection yoke in accordance with the first embodiment of the present invention, since the auxiliary coil 141 for the secondary 4-pole convergence yoke 140 is wound at the slitted holder 132 or the muscle type holder 132', no inverse-magnetic field due to an induced magnetic field is generated at the auxiliary coil for the secondary 4-pole convergence yoke 140 owing to the magnetic field formed by the horizontal deflection coil 131. Thus, the deflection yoke has the effect that factors changing the convergence of the beams on the screen due to the inverse-magnetic field are reduced and no induced current preventing circuit is necessary.

In addition, since as soon as the auxiliary coil 140 for the secondary 4-pole convergence yoke is first wound at the slitted holder 132 or the muscle type holder 132', the horizontal deflection coil 131 can be wound, so that its productivity can be improved compared with the conventional method in which the coil is wound at the ferrite core.

Moreover, since the secondary 4-pole convergence yoke is implemented at the holder 132 where the horizontal deflection coil 131 is wound, rather than at the ferrite core, the sensitivity of the secondary 4-pole convergence yoke 140 can be much improved.

Figure 15:
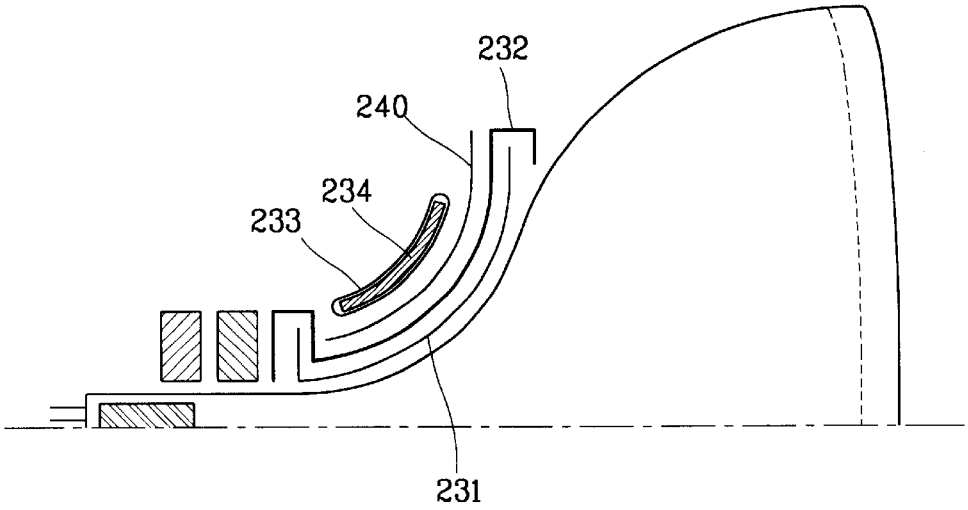
FIG. 15 is a schematic sectional view showing the construction of a Braun tube having a deflection yoke in accordance with a second embodiment of the present invention.

FIG. 15 is a schematic sectional view showing the construction of a Braun tube having a deflection yoke in accordance with a second embodiment of the present invention.

The deflection yoke in accordance with the second embodiment of the present invention is characterized particularly in that the secondary 4-pole convergence yoke 240 is installed with the auxiliary coil wound at the outer side of the slitted holder 232.

That is, the horizontal deflection coil 231 is wound at the inner side of the slitted holder 232, and the secondary 4-pole convergence yoke 240 is wound at the outer side of a slitted holder 232.

The vertical deflection coil 233 may be wound along with the secondary 4-pole convergence yoke 240 at the outer side of the slitted holder 232, but it may also be implemented to be wound at the ferrite core 234 as shown in FIG. 15.

Figure 16:
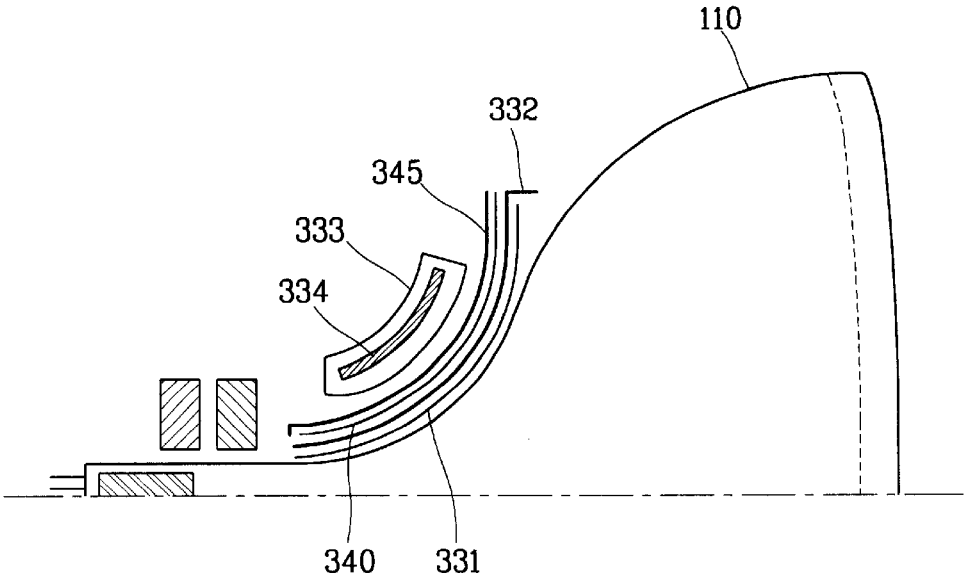
FIG. 16 is a schematic sectional view showing the construction of a Braun tube having a deflection yoke in accordance with a third embodiment of the present invention.
Figure 17:
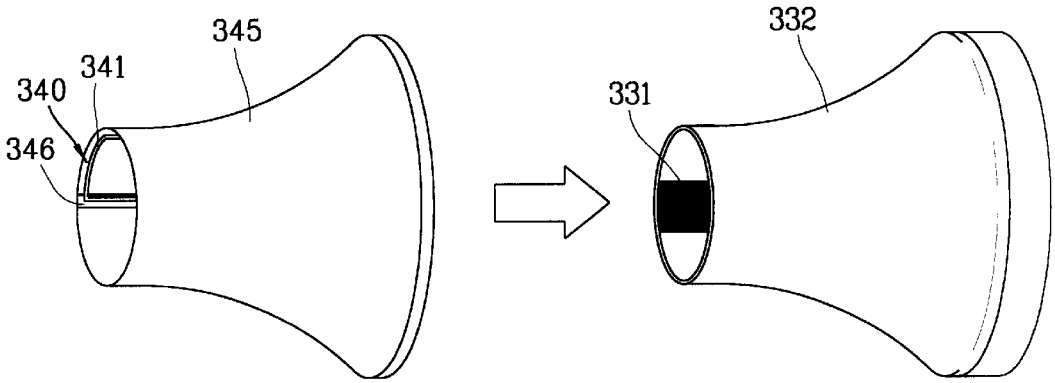
FIG. 17 is an exploded perspective view showing a state of combination of two holders in accordance with the third embodiment of the present invention.

FIG. 16 is a schematic-sectional view showing the construction of a Braun tube having a deflection yoke in accordance with a third embodiment of the present invention, and FIG. 17 is an exploded perspective view showing a state of combination of two holders in accordance with the third embodiment of the present invention.

Compared with the first and the second embodiments in which the secondary 4-pole convergence yoke 140 is installed directly at the holder 132 where the horizontal deflection coil is installed, the third embodiment of the present invention is characterized particularly in that an auxiliary coil 341 constructing a secondary 4-pole convergence yoke 340 is wound at an additional holder 345.

In other words, a horizontal deflection coil 331 is wound at the inner side of a first holder 332, and a secondary 4-pole convergence yoke 340 is installed with an auxiliary coil 341 wound at the inner side of a second holder 345.

The second holder 345 with the secondary 4-pole convergence yoke 340 mounted thereon is combined to be assembled at the outer side of the first holder 332.

A ferrite core 334 is positioned at the outer side of the second holder 345 and a vertical deflection coil 333 may be installed at the outer side of the first holder 332 or at the position of the ferrite core 334 as shown in FIG. 16.

A winding groove 345 is formed at four portions of 90° intervals at the inner side of the second holder 345 so that the auxiliary coil 341 constructing the second 4-pole convergence yoke 340 can be positioned therein.

The auxiliary coil 341 forming the secondary 4-pole convergence yoke 340 is wound at the winding type groove 345 of the second holder 345 running in the directions of 0°, 90°, 180° and 270° centering around the horizontal axis of Braun tube.

In detail, similarly to the winding method of the first embodiment of the present invention, the secondary 4-pole convergence yoke 340 is constructed in such a manner that the auxiliary coil 341 is successively wound starting from one end of the second holder 345, extending to the other end at the same angle running in a straight line in the longitudinal direction of the holder, making a turn of about 90° at the other end to form a flange, extending to the first end again running in a straight line in the vicinity of 90° from the starting position, making a turn of about 90° at the first end to form another flange, extending back to the other end running in a straight line in the vicinity of 180° from the starting position, making a further turn of about 90° from the other end to form a flange, and extending back again to the first end running in a straight line in the vicinity of 270° from the starting position.

Figure 18:
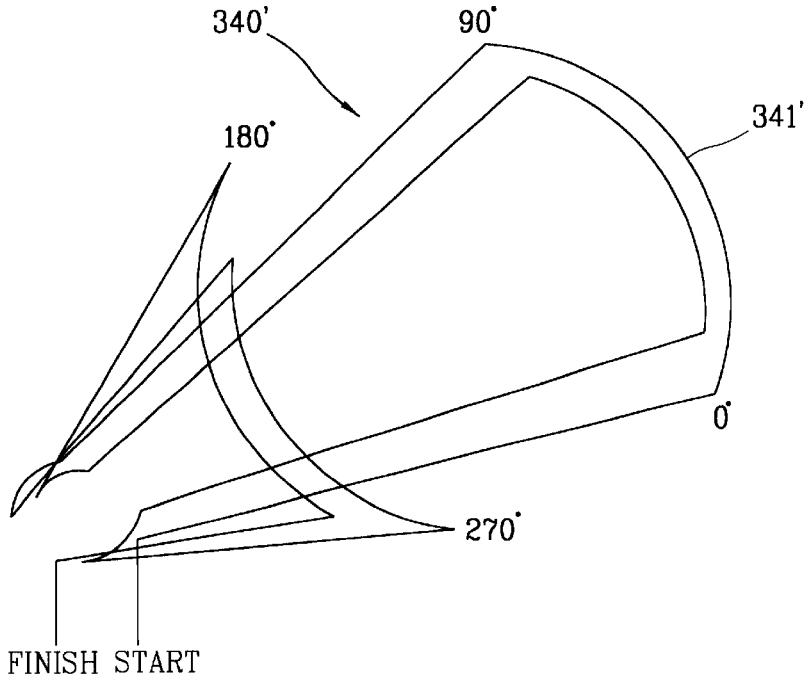
FIG. 18 is a perspective view showing a shaped state of an auxiliary coil for a secondary 4-pole convergence yoke in accordance with the third embodiment of the present invention.

FIG. 18 is a perspective view showing a shaped state of an auxiliary coil for a secondary 4-pole convergence yoke in accordance with the third embodiment of the present invention.

Compared with the illustration in FIG. 17 in which the auxiliary coil 341 forming the secondary 4-pole convergence yoke 340 is directly wound at the second holder 345, in FIG. 18, an auxiliary coil 341' forming the secondary 4-pole convergence yoke 340' is shaped to a certain form and mounted inside the second holder.

That is, after the auxiliary coil 341' to form the secondary 4-pole convergence yoke 340' is wound and a certain current applied to the auxiliary coil to maintain the shaped state to be mounted at the second holder, and then the auxiliary coil 341' is mounted in the second holder to implement the secondary 4-pole convergence yoke 340'.

Figure 19:
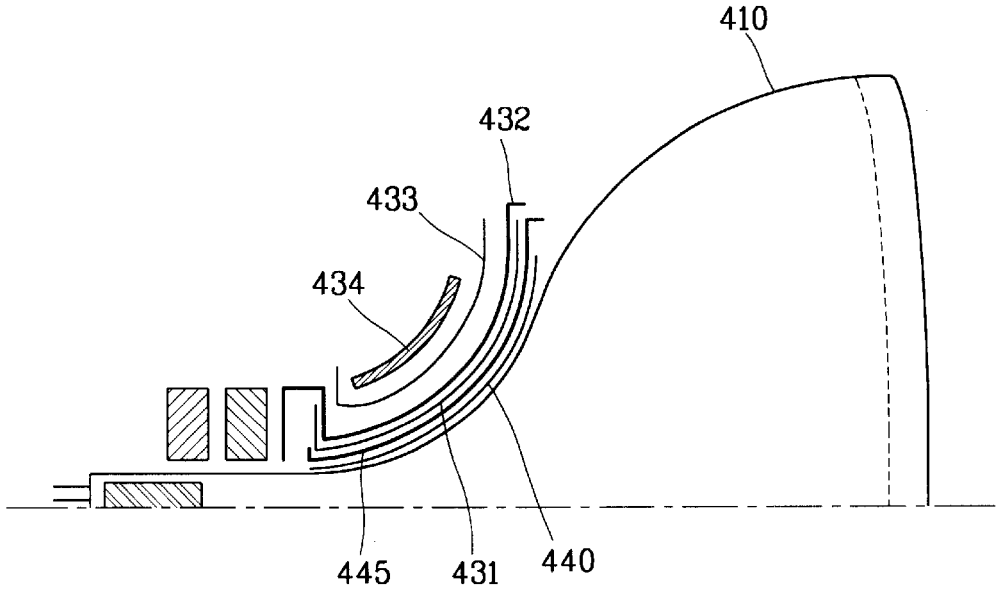
FIG. 19 is a schematic sectional view showing the construction of a Braun tube having a deflection yoke in accordance with a fourth embodiment of the present invention.

FIG. 19 is a schematic sectional view showing the construction of a Braun tube having a deflection yoke in accordance with a fourth embodiment of the present invention.

In the deflection yoke according to the fourth embodiment of the present invention, similarly to in the third embodiment, an auxiliary coil 441 constructing a secondary 4-pole convergence yoke 440 is wound at an additional holder 445.

That is, a horizontal deflection coil 431 and a vertical deflection coil 433 are respectively wound at the inner side and the outer side of a first holder 432, and a secondary 4-pole convergence yoke 440 is installed as an auxiliary coil wound at the inner side of a second holder 445.

Especially, the second holder 445 at which the secondary 4-pole convergence yoke 440 is wound is combined at the inner side of the first holder 432 and assembled at the very periphery of a funnel 410.

A ferrite core 434 is positioned at the outer periphery of the first holder 445.

The second holder 445 includes a winding groove formed at its inner side so that an auxiliary coil forming the secondary 4-pole convergence yoke 440 can be wound, for which the same winding method as that described for the first embodiment is performed.

Figure 20:
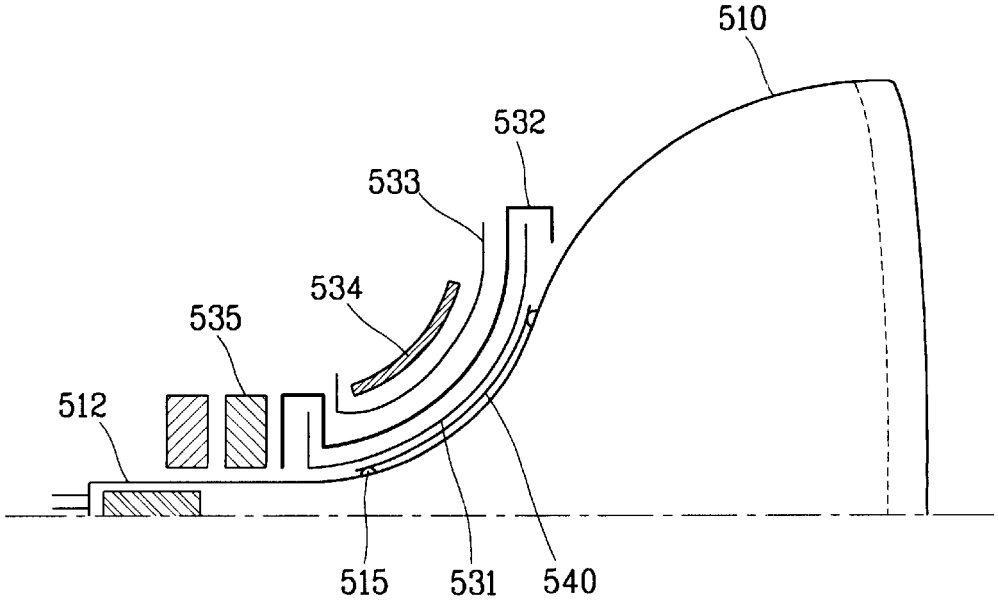
FIG. 20 is a schematic sectional view showing the construction of a Braun tube having a deflection yoke in accordance with a fifth embodiment of the present invention.
Figure 21:
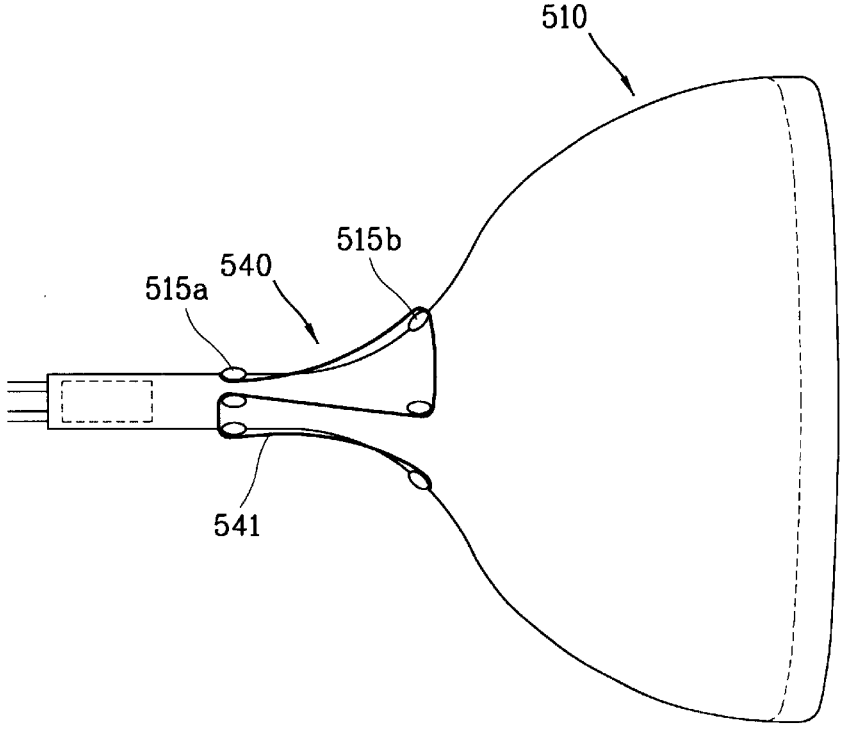
FIG. 21 is a side view showing a state that an auxiliary coil is wound at a funnel of a Braun tube in accordance with the fifth embodiment of the present invention.

FIG. 20 is a schematic sectional view showing the construction of Braun tube having a deflection yoke in accordance with a fifth embodiment of the present invention and FIG. 21 is a side view showing a state that an auxiliary coil is wound at a funnel of the Braun tube in accordance with the fifth embodiment of the present invention.

The deflection yoke in accordance with the fifth embodiment of the present invention is constructed such that a primary 4-pole convergence yoke 535 is installed at the periphery of a neck portion 512 of a funnel 510 of the Braun tube, and a secondary 4-pole convergence yoke 540 is mounted at the very outer side of a cone portion of the funnel 510, that is, at the inner side of a holder 532 at which horizontal and vertical deflection coils 531 and 533 and a ferrite core 534 are mounted.

Especially, a plurality of protrusions 515 are formed to provide reference locations when the secondary 4-pole convergence yoke 510 is mounted. Four protrusions 515 are formed at both ends of the funnel 510 as shown in FIG. 21.

Accordingly, the secondary 4-pole convergence yoke 540 is constructed in a manner that the auxiliary coil 541 is successively wound starting from one protrusion 515*a* of the funnel 510, extended to the corresponding opposite end protrusion 515*b* at the same angle running in a straight line, making a turn of about 90° at the other end to form a flange, extended back to the first end again running in a straight line in the vicinity of 90° from the starting position, making a turn of about 90° at the first end to form a flange, extending to the other end running in a straight line in the vicinity of 180° from the starting position, making a turn of about 90° at the other end to form a flange, and extending again to the first end running in a straight line in the vicinity of 270° from the starting position.

The winding method is performed in the same manner as that shown in FIG. 12.

After the secondary 4-pole convergence yoke 540 is positioned to fit the protrusions 515 of the funnel 510, it is fixed by using tape or an adhesive to prevent movement.

And then, the holder 532 where the horizontal and the vertical deflection coils 531 and 533 are installed and the ferrite core 534 are mounted at the periphery of the secondary 4-pole convergence yoke 540.

Figure 1:
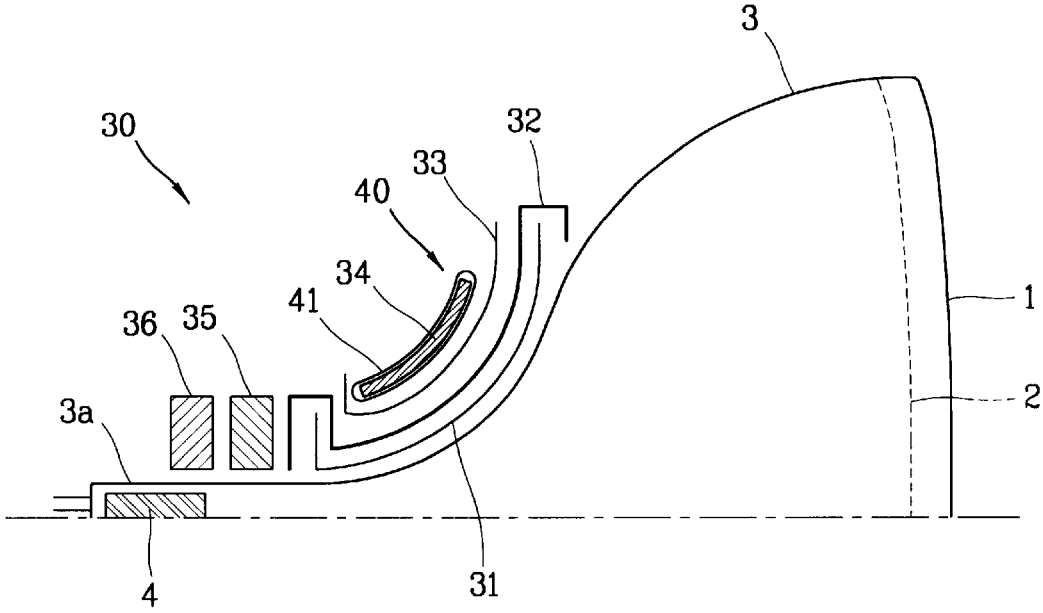
FIG. 1 CONVENTIONAL ART
FIG. 1 is a schematic view of Braun tube having a deflection yoke in accordance with the conventional art.
Figure 2A:
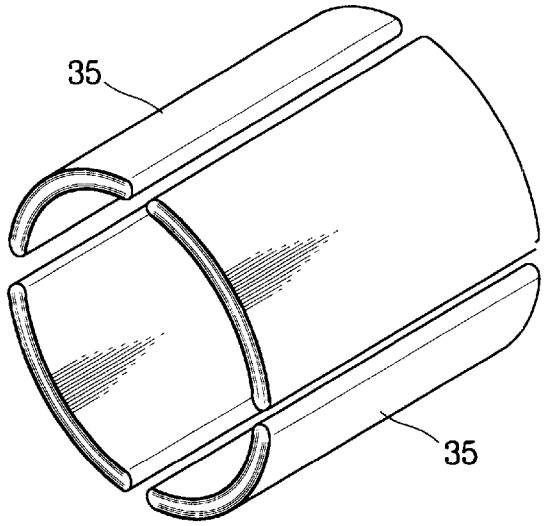
FIG. 2A CONVENTIONAL ART
FIG. 2A is a perspective view of a primary 4-pole convergence yoke in accordance with the conventional art.
Figure 2B:
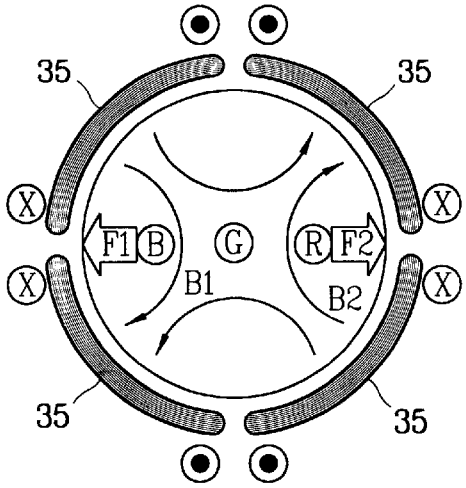
FIG. 2B CONVENTIONAL ART
FIG. 2B is a diagram showing the formation of a magnetic field by the primary 4-pole convergence yoke in accordance with the conventional art.
Figure 3A:
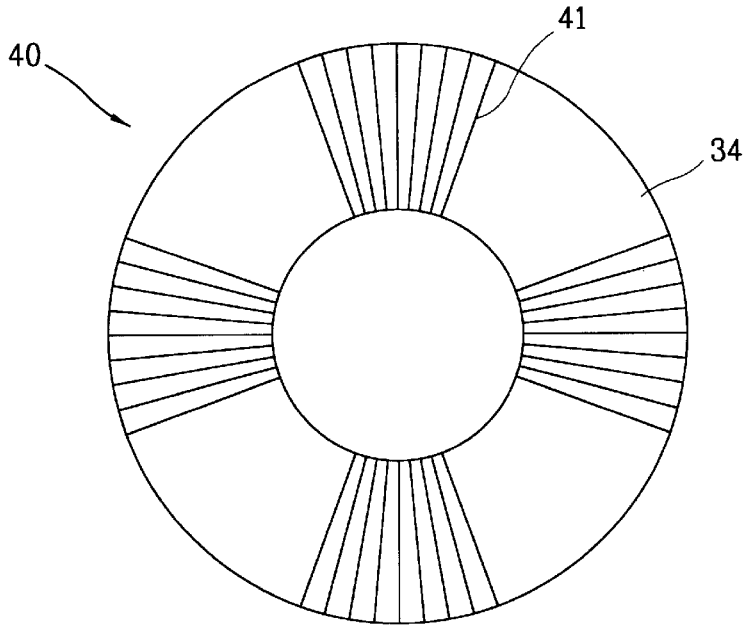
FIG. 3A CONVENTIONAL ART
FIG. 3A is a plan view of a secondary 4-pole convergence yoke.
Figure 3B:
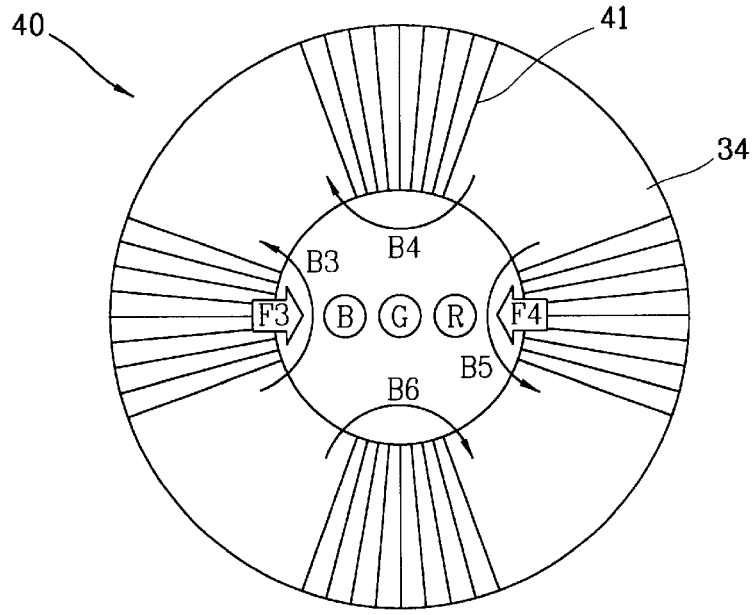
FIG. 3B CONVENTIONAL ART
FIG. 3B is a diagram showing the formation of a magnetic field by the secondary 4-pole convergence yoke in accordance with the conventional art.
Figure 4:
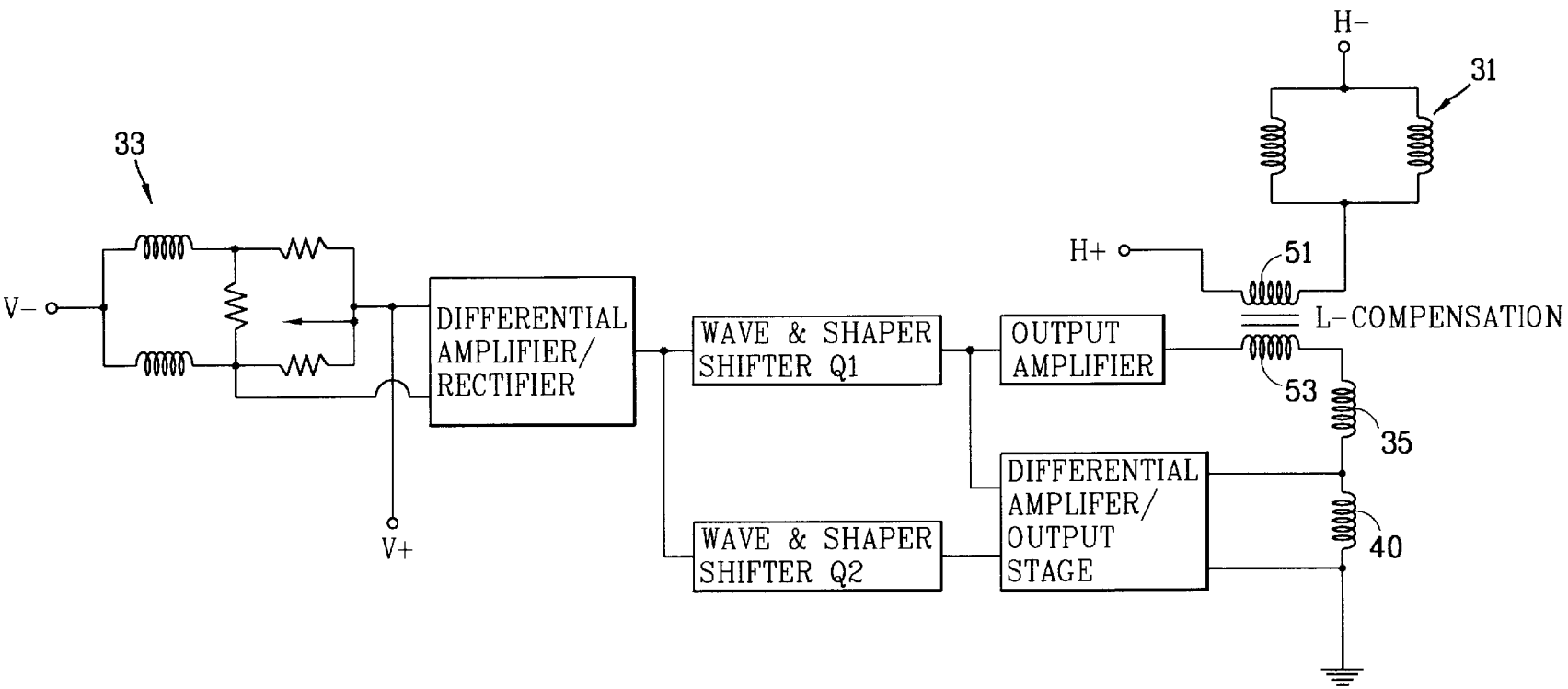
FIG. 4 CONVENTIONAL ART
FIG. 4 is a schematic circuit diagram showing a drive circuit diagram of the convergence yoke in accordance with the conventional art.
Figure 5:
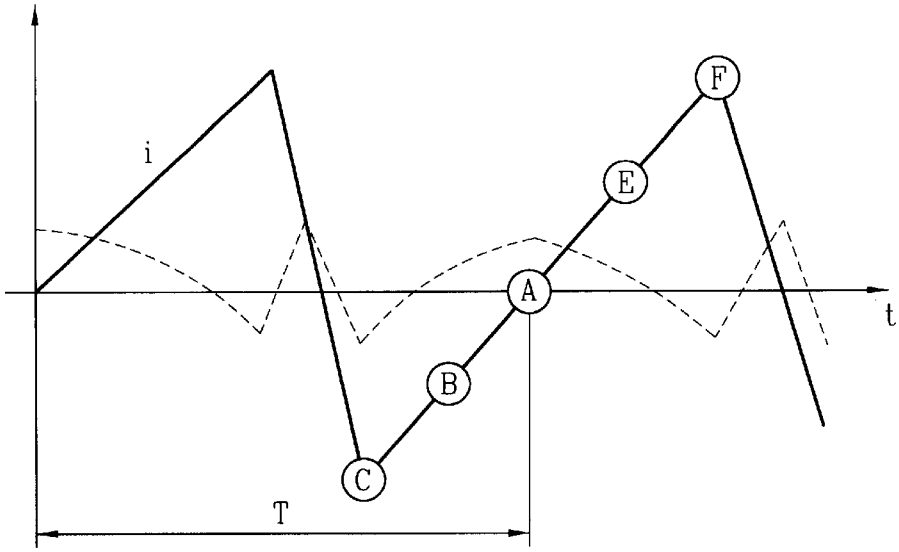
FIG. 5 CONVENTIONAL ART
FIG. 5 is a graph showing a pattern of current applied to a deflection yoke in accordance with the conventional art.
Figure 6:
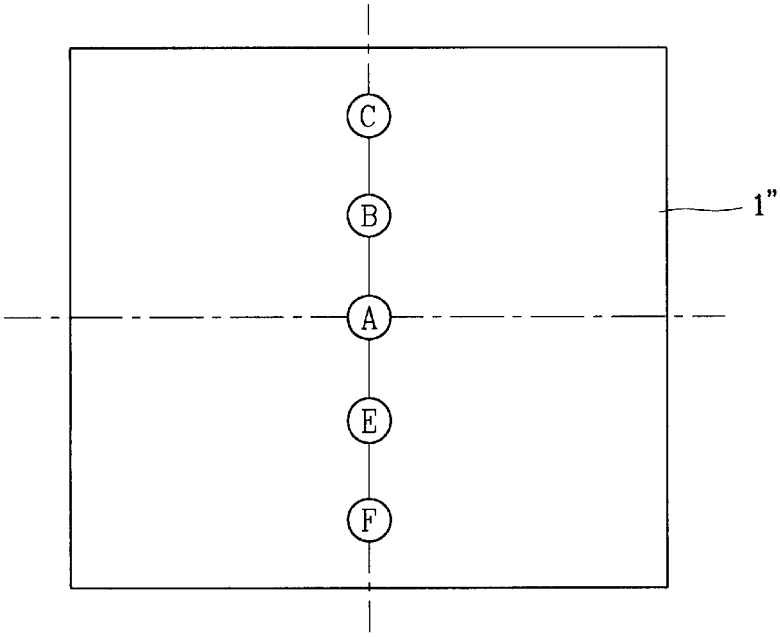
FIG. 6 CONVENTIONAL ART
FIG. 6 is a reference diagram showing screen positions of an electron beam spot in accordance with the conventional art.
Figure 7:
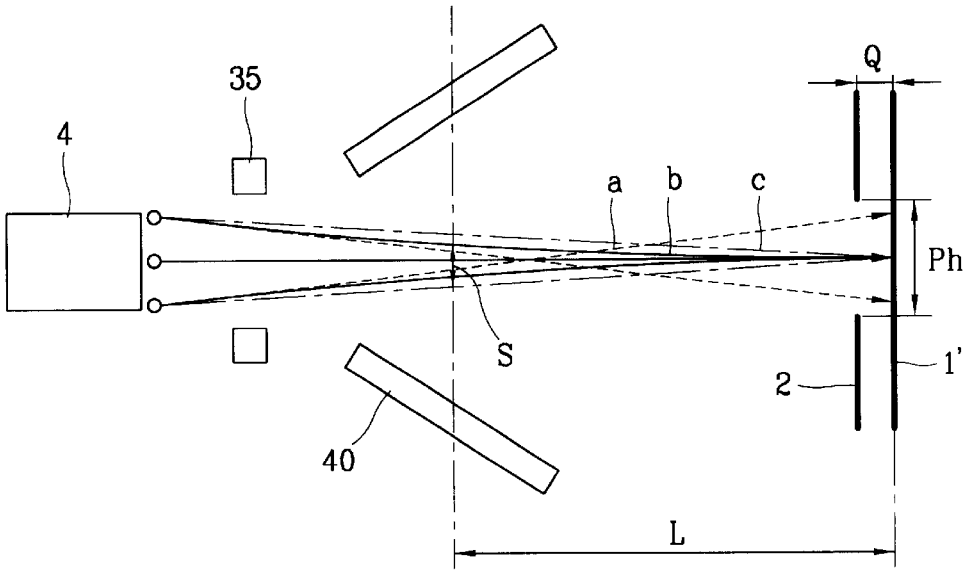
FIG. 7 CONVENTIONAL ART
FIG. 7 is a schematic diagram showing operation of the primary and the secondary 4-pole convergence yokes in accordance with the conventional art.
Figure 8:
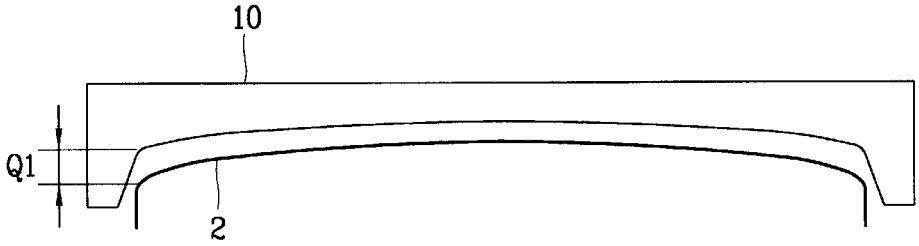
FIG. 8 CONVENTIONAL ART
FIGS. 8A and 8B are diagrams showing curvature differences of a Braun tube panel and a shadow mask in accordance with the conventional art.
Figure 8:
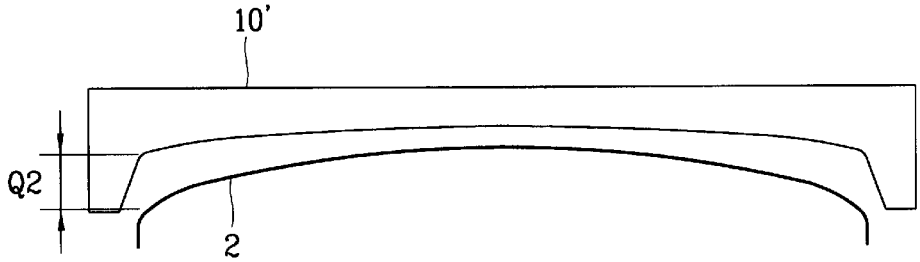
FIG. 8 CONVENTIONAL ART
Figure 9:
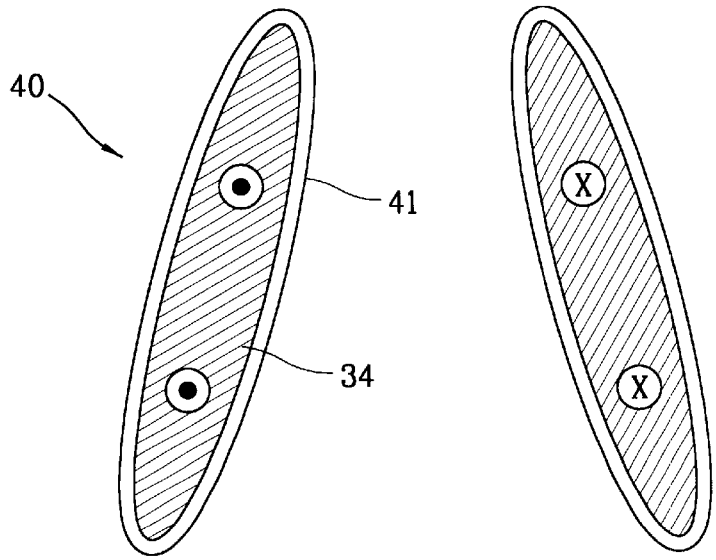
FIG. 9 CONVENTIONAL ART
FIG. 9 is a sectional view of a ferrite core where the secondary 4-pole convergence yoke is mounted in accordance with the conventional art.

When a current shown by the a dotted line in FIG. 5 is applied to the secondary 4-pole convergence yoke 540, magnetic fields (B7~B10) as shown in FIG. 13 are generated, so that, as shown in FIG. 6, at the point 'A' of the screen, the R beam is deflected by a force (F6) of the magnetic field (B9) and is moved in the direction of 9 o'clock and the B beam is deflected by the force (F5) of the magnetic field (B7) and is moved in the direction of 3 o'clock.

At the point 'B' of the screen, the R and the B beams are not moved. As shown in FIG. 5, since the current direction at the points 'C' and 'F' is the opposite to the current direction at the point 'A' of the, the magnetic fields are formed in the opposite direction to the magnetic field of FIG. 13, so that the R beam and the B beam are moved in the opposite direction to the point 'A' of the screen.

This is the opposite direction to the magnetic field generated by the primary 4-pole convergence yoke 535, so that the misconvergence generated at the primary 4-pole convergence yoke 535 can be corrected through the secondary 4-pole convergence yoke 540 installed at the periphery of the funnel 510.

Accordingly, in this embodiment, the secondary 4-pole convergence yoke 540 is directly mounted at the funnel 510, so that no inverse-magnetic field due to the induced magnetic field is generated at the auxiliary coil 541 for the secondary 4-pole convergence yoke owing to the magnetic field at the horizontal deflection coil 531. Thus, the production cost can be reduced.

In addition, since the auxiliary coil for the secondary 4-pole convergence yoke 540 is mounted very closely to the cone portion of the funnel 510, the sensitivity of the secondary 4-pole convergence can be improved compared to the conventional art in which the secondary 4-pole convergence yoke is implemented at the ferrite core.

Figure 22:
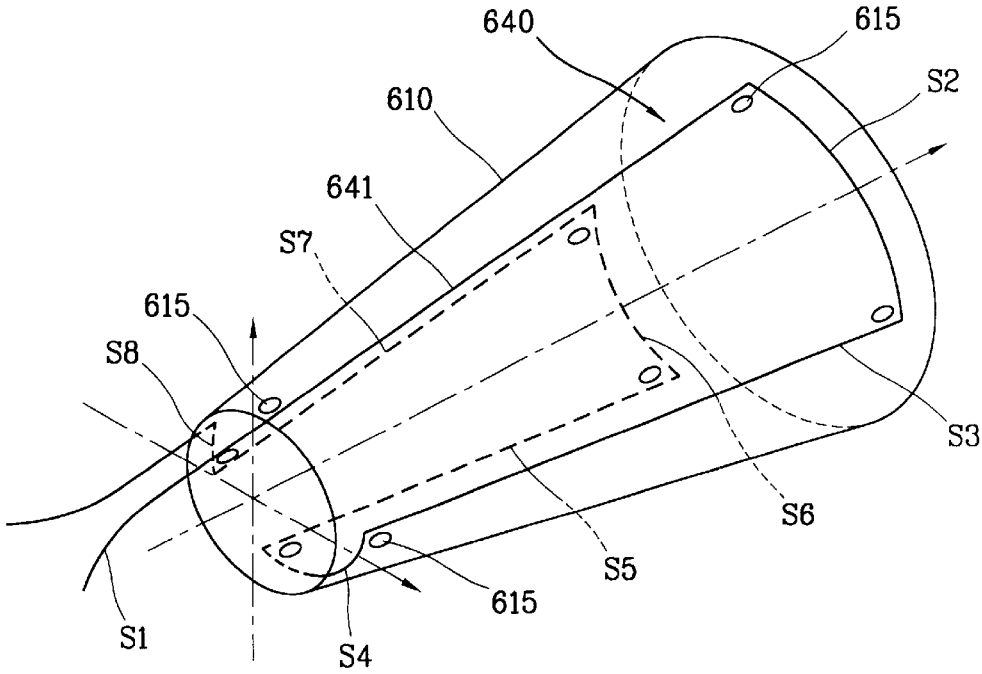
FIG. 22 is a perspective diagram showing how a film coil for a secondary 4-pole convergence is wound in accordance with a sixth embodiment of the present invention.
Figure 23A:
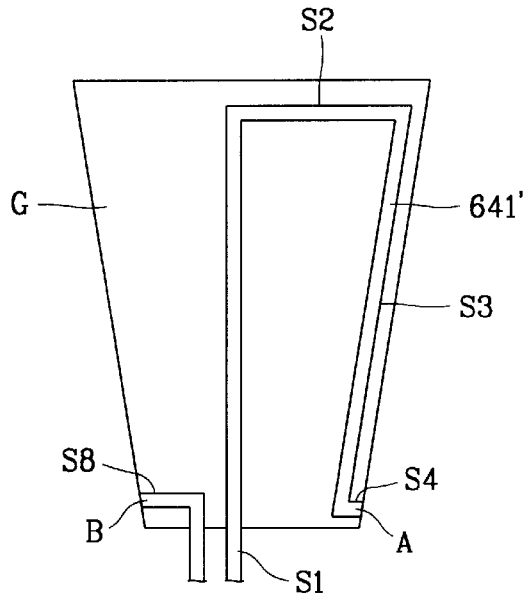
FIGS. 23A and 23B are right and left side views showing how the film coil for the secondary 4-pole convergence yoke is wound at a funnel in accordance with the sixth embodiment of the present invention.
Figure 23B:
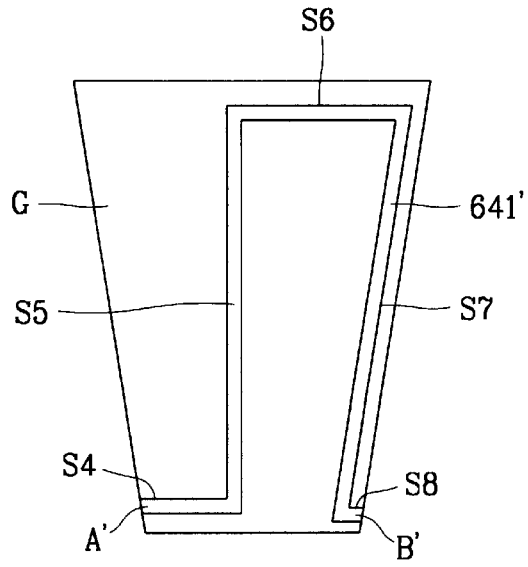

FIG. 22 is a perspective diagram showing how a film coil for a secondary 4-pole convergence is wound in accordance with a sixth embodiment of the present invention, and FIGS. 23A and 23B are right and left side views showing the state that the film coil for the secondary 4-pole convergence yoke is wound at a funnel of a Braun tube in accordance with the sixth embodiment of the present invention.

Similarly to the fifth embodiment of the present invention, also in the sixth embodiment of the present invention, a secondary 4-pole convergence yoke is mounted on protrusions 610 of a funnel 616 except that the secondary 4-pole convergence yoke 640 is formed as a film or tape type made of a flat wire 641.

In detail, after a film made of a flat wire 641' is fabricated on a jig (G) in the manner shown in FIG. 23, portions 'A' and 'B' of the film shown in FIG. 23A are respectively connected with portions 'A" and 'B" of the film shown in FIG. 23B, to form a secondary 4-pole convergence yoke.

The thusly formed secondary 4-pole convergence yoke 640 can be mounted by using reference protrusions 615 formed at a funnel 610 of a Braun tube as shown in FIG. 22.

Meanwhile, FIGS. 22 and 23A and 23B also illustrate the winding order of the flat wire.

Figure 24A:
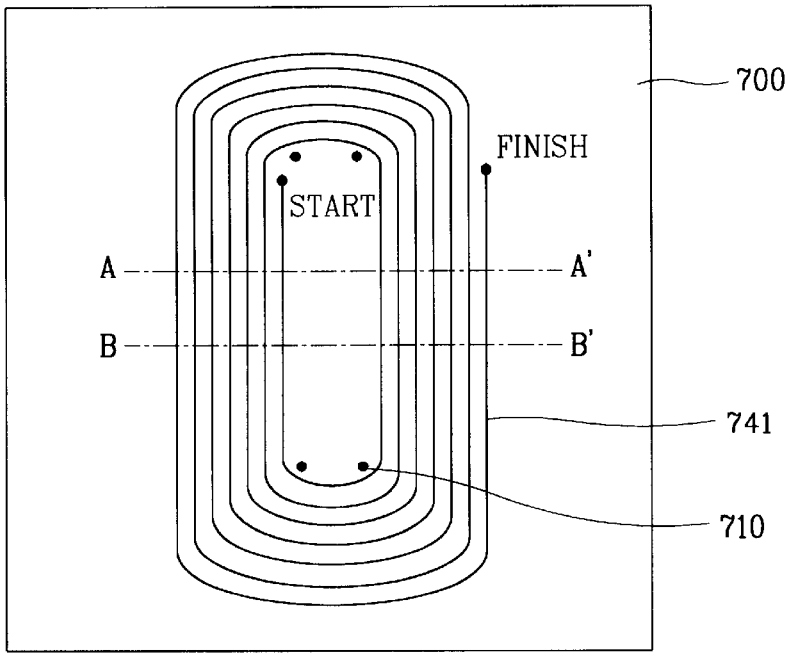
FIG. 24A is a diagram showing how a coil is wound on a plane in a method for fabricating an auxiliary coil for the secondary 4-pole convergence yoke in accordance with the present invention.
Figure 24B:
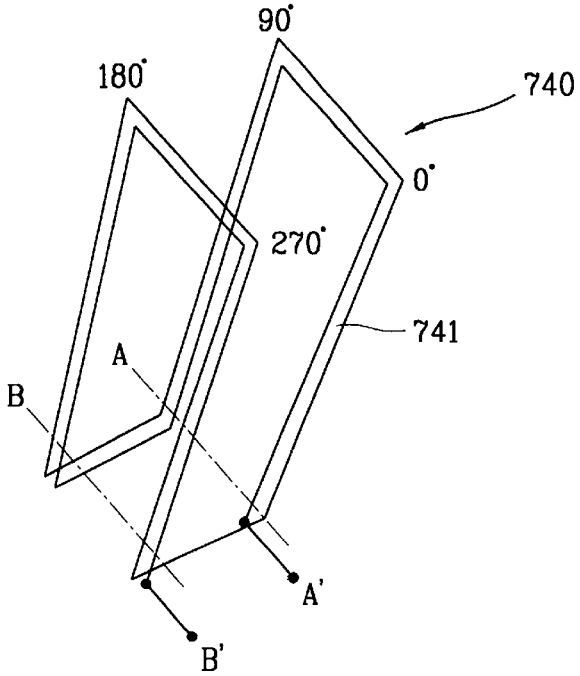
FIG. 24B is a perspective view showing how the auxiliary coil of FIG. 24A is bent in accordance with the present invention.
Figure 25:
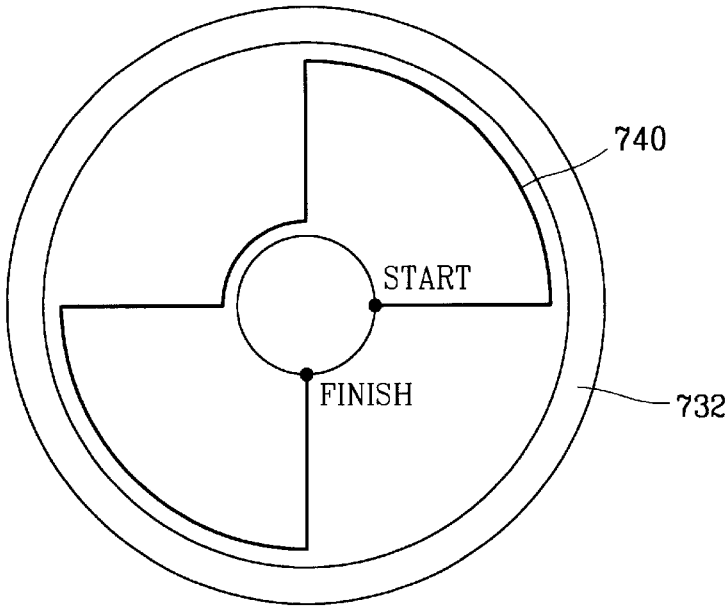
FIG. 25 is a diagram showing a state that the bent auxiliary coil of FIG. 24B is mounted at the inner side of a holder in accordance with the present invention.
Figure 26:
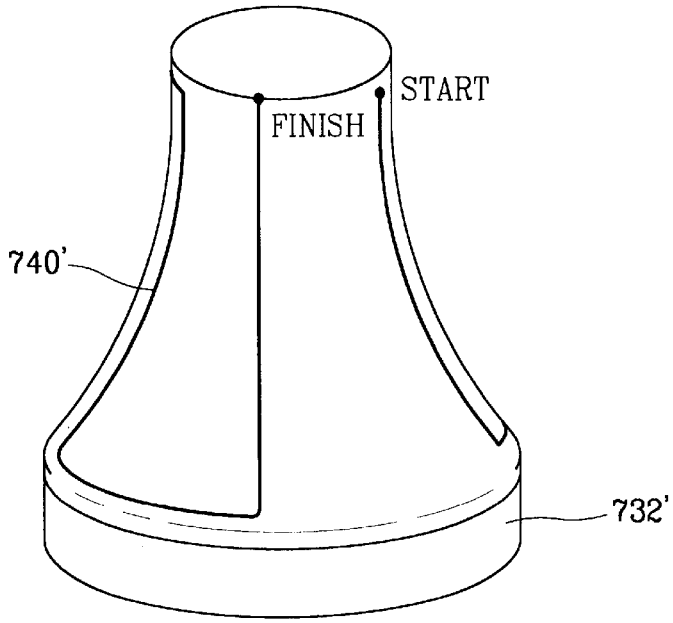
FIG. 26 is a perspective diagram showing a state that the bent auxiliary coil of FIG. 24B is mounted at the outer side of a holder in accordance with the present invention.

FIG. 24A is a diagram showing a state that a coil is wound on a plane in a method for fabricating an auxiliary coil for the secondary 4-pole convergence yoke in accordance with the present invention, FIG. 24B is a perspective view showing a state that the auxiliary coil of FIG. 24A is bent in accordance with the present invention, FIG. 25 is a diagram showing a state that the bent auxiliary coil of FIG. 24B is mounted at the inner side of a holder in accordance with the present invention, and FIG. 26 is a diagram showing a state that the bent auxiliary coil of FIG. 24B is mounted at the outer side of a holder in accordance with the present invention.

A method for fabricating an auxiliary coil 740 for a secondary 4-pole convergence yoke of the present invention will now be described.

First, with reference to FIG. 24A, a copper wire is wound with as many as an arbitrary number of windings between two flat plates 700 maintaining a frame, that is, an upper flat plate and a lower flat plate.

At this time, four pins 710 determining the shape of a coil 741 are inserted to connect the upper and the lower flat plates. The four pins 710 are positioned having the same length as the axial direction of a Braun tube of a holder and positioned at the upper flat plate and the lower flat plate to have the winding angles of 0°, 90°, 180° and 270°.

And then, in order to maintain the form of the thusly wound auxiliary coil 741', the auxiliary coil 741 is first shaped by applying a few amperes to dozens of amperes between the starting end and the finishing end.

Next, with reference to FIG. 24B, a secondary shaping is performed in that a portion A–A' and a portion B-B' of the first shaped auxiliary coil 741' are forced in the direction that the auxiliary coil is bent downwardly by using a pusher having the same curvature as the inner curvature of the holder. Thereby, the auxiliary coil 740 for a secondary 4-pole convergence yoke is formed in a double 'U' shape.

Thereafter, the thusly fabricated auxiliary coil 740 for the secondary 4-pole convergence yoke can be attached at the inner side of the holder 732. Also, after attaching the auxiliary coil 740, a horizontal deflection coil as shown in FIG. 14 may be assembled thereto.

In addition, after the auxiliary coil 740 for the 4-pole convergence yoke is formed as described above, as shown in FIG. 26, a secondary shaping may be performed in a manner that the auxiliary coil is forced to be bent downwardly by using the pusher having the- same curvature as that of the outer side of the holder 732', so that an auxiliary coil 740' for the secondary 4-pole convergence formed as shown in FIG. 26 may be fabricated.

As mentioned above, in the case that after the auxiliary coil 740 for the secondary 4-pole convergence yoke is wound by using the flat plate 700, it is secondly processed by using the pusher having the same curvature as that of the inner side or the outer side of the holder 732, and is then mounted at the holder 732, which has advantages that its fabrication is easy compared with the method in which the winding is directly performed on the ferrite core, and the fabricating time period is reduced, leading to a great improvement in productivity.

In addition, in the above described preferred embodiments, the separately fabricated auxiliary coil for the secondary 4-pole convergence yoke is installed at the holder or the funnel, rather than being directly wound at the holder or the funnel, so that the assembly process of the deflection yoke can be facilitated.

As the present invention may be embodied in several forms without departing from the spirit or essential characteristics thereof, it should also be understood that the above-described embodiments are not limited by any of the is details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A deflection yoke for a Braun tube including a primary 4-pole convergence yoke adapted to be positioned at a neck portion of a funnel of a Braun tube and a secondary 4-pole convergence yoke adapted to be positioned in the vicinity of the funnel where horizontal and vertical deflection coils and a ferrite core are installed, for correcting a misconvergence generated due to the primary 4-pole convergence yoke, wherein at least one of the vertical and the horizontal deflection coils is wound at a first holder, and the secondary 4-pole convergence yoke comprises an auxiliary coil that is installed in such a manner that the auxiliary coil is wound on at least one of an inner side or an outer side of the first holder.

2. The deflection yoke of claim 1, wherein the first holder has winding grooves formed at either the inner side or the outer side thereof so that the auxiliary coil forming the secondary 4-pole convergence yoke can be positioned thereon.

3. The deflection yoke of claim 2, wherein the winding grooves are formed in the longitudinal direction of the first holder at 90° intervals.

4. The deflection yoke of claim 3, wherein the auxiliary coil forming the secondary 4-pole convergence yoke is wound at the winding grooves in the directions of 0°, 90°, 180° and 270° centering around a horizontal axis of the first holder.

5. The deflection yoke of claim 1, wherein the secondary 4-pole convergence yoke is constructed in such a manner that the auxiliary coil is successively wound starting from one end of the first holder, extending to another end of the first holder at the same angle running in a straight line in the longitudinal direction of the holder, making a turn of about 90° at the other end, extending to the first end again running in a straight line in the vicinity of 90° from the starting position, making a turn of about 90° at the first end, extending to the other end running in a straight line in the vicinity of 180° from the starting position, making a turn of about 90° from the other end, and extending back again to the first end running in a straight line in the vicinity of 270° from the starting position.

6. The deflection yoke of claim 1, wherein the deflection coil is installed wound at the outer side of the first holder and the secondary 4-pole convergence yoke is installed such that the auxiliary coil is wound at the inner side of the first holder.

7. The deflection yoke of claim 1, wherein the auxiliary coil forming the secondary 4-pole convergence yoke is shaped to a certain form and combined with the first holder.

8. A deflection for a Braun tube including a primary 4-pole convergence yoke adopted to be positioned at a neck portion of a funnel of a Braun tube and a secondary 4-pole convergence yoke positioned in the vicinity of the funnel where horizontal and vertical deflection coils and a ferrite core are installed, for correcting a misconvergence generated due to the primary 4-pole convergence yoke, wherein at least one of the vertical and the horizontal deflection coils is wound at a first holder, and a secondary 4-pole convergence yoke is installed as an auxiliary coil at a second hole winch is insertable into an inner side or an outer side of the first holder.

9. The deflection yoke of claim 8, wherein the second holder has winding grooves are formed at either the inner side or the outer side thereof so that the auxiliary coil forming the secondary 4-pole convergence yoke can be positioned thereon.

10. The deflection yoke of claim 9, wherein the winding type grooves are formed in the longitudinal direction of the second holder at four positions at every 90° intervals.

11. The deflection yoke of claim 9, wherein the auxiliary coil forming the secondary 4-pole convergence yoke is wound at the winding type grooves in the directions of 0°, 90°, 180° and 270° centering around a horizontal axis.

12. The deflection yoke of claim 8, wherein the secondary 4-pole convergence yoke is constructed such that the auxiliary coil is successively wound starting from a first end of the second holder, extending to another end thereof at the same angle running in a straight line in the longitudinal direction of the second holder, making a turn of about 90° at the other end, extending to the first end again in a straight line in the vicinity of 90° from the starting position, making a another turn of about 90° at the first end, extending to the other end in a straight line in the vicinity of 180° from the starting position, making a turn of about 90° at the other end, and extending again to the first end running in a straight line in the vicinity of 270° from the starting position.

13. A deflection yoke for a Braun tube including a primary 4-pole convergence yoke adapted to be positioned at a neck portion of a funnel of a Braun tube and a secondary 4-pole convergence yoke positioned in the vicinity of the funnel where horizontal and vertical deflection coils and a ferrite core are installed, for correcting a misconvergence generated due to the primary 4-pole convergence yoke, wherein the secondary 4-pole convergence yoke is mounted at an outer side of the funnel.

14. The deflection yoke of claim 13, wherein the secondary 4-pole convergence yoke is formed by an auxiliary coil wound with several windings.

15. The deflection yoke of claim 13, wherein the secondary 4-pole convergence yoke is formed as a film type made of flat wire.

16. The deflection yoke of claim 13, wherein a plurality of protrusions are formed at the Braun tube funnel to serve as reference locations when the secondary 4-pole convergence yoke is mounted.

17. The deflection yoke of claim 16, wherein a plurality of protrusions are formed at both ends of the funnel.

18. The deflection of yoke of claim 17, wherein the secondary 4-pole convergence yoke is constructed such that the auxiliary coil is successively wound starting from a first protrusion at a first end of the funnel, extending to the corresponding protrusion at the other end of the funnel at the same angle running in a straight line, making a turn of about 90° at the other end, extending back to the first end again in a straight line, making a turn of about 90° at the other end, extending back to the first end again in a straight line in the vicinity of 90° from the starting position, making a turn of about 90° at the first end, extending to the other end in a straight line in the vicinity of 180° from the starting position, making a turn of about 90° at the other end, and extending again to the first end in a straight line in the vicinity of 270° from the starting position.

* * * * *